US005652952A

United States Patent [19]

Katsuhara

[11] Patent Number: 5,652,952

[45] Date of Patent: Jul. 29, 1997

[54] METHOD OF ADJUSTING DENSITY DETECTING DEVICE USED FOR IMAGE FORMING APPARATUS

[75] Inventor: Kenji Katsuhara, Osaka, Japan

[73] Assignee: Mita Industrial Co., Ltd., Osaka, Japan

[21] Appl. No.: 515,586

[22] Filed: Aug. 16, 1995

[30] Foreign Application Priority Data

Sep. 20, 1994 [JP] Japan ..... 6-225178

[51] Int. Cl.[6] ..... G03G 15/00

[52] U.S. Cl. ..... 399/72; 399/74

[58] Field of Search ..... 355/208, 214, 355/246; 399/72, 74

[56] References Cited

U.S. PATENT DOCUMENTS

| | | | |
|---|---|---|---|
| 4,801,980 | 1/1989 | Arai et al. . | |
| 4,878,082 | 10/1989 | Matsushita et al. | 355/208 |
| 5,006,896 | 4/1991 | Koichi et al. | 355/246 |
| 5,351,107 | 9/1994 | Nakane et al. | 355/208 |
| 5,477,312 | 12/1995 | Hori | 355/208 |
| 5,543,895 | 8/1996 | Kasuhara | 355/203 |

*Primary Examiner*—Robert Beatty

*Attorney, Agent, or Firm*—Beveridge, DeGrandi, Weilacher & Young, LLP

[57] ABSTRACT

A method and an apparatus for selecting an amount of light to be irradiated for fog detection onto a photoreceptor from a density detecting device out of amounts of light for low density or for high density. A real original is illuminated by a predetermined amount of illuminating light, whereby a toner image corresponding to the real original is formed on the photoreceptor. Light of an amount for low density from the density detecting device is irradiated onto the toner image to acquire a first density data. Thereafter, a pseudo original is illuminated by the predetermined amount of illuminating light, whereby a toner image corresponding to the pseudo original is formed. Light of the amount for low density from the density detecting device is irradiated onto the toner image to acquire a second density data. The difference between the first and the second density data is compared with a predetermined threshold value. If the difference is less than the threshold value, the amount of light for low density is selected for fog detection. If the difference is not less than the threshold value, an amount of light for high density is selected.

16 Claims, 6 Drawing Sheets

METHOD OF ADJUSTING DENSITY DETECTING DEVICE USED FOR IMAGE FORMING APPARATUS

BACKGROUND OF THE INVENTION

1. Field of the Invention

The present invention relates to a method and apparatus for adjusting a density detecting device which is used for an image forming apparatus for forming an image by an electrophotographic process, for example, an electrostatic copying machine, and which device is for outputting density data utilized in adjusting the image forming conditions such as the amount of charge, the amount of exposure and the developing bias so as to keep the formed image high in quality.

2. Description of the Related Art

In the electrostatic copying machine, a copy image is formed in the following manner. Specifically, a real original which is put on a transparent platen to reproduce the image thereof is illuminated and scanned. Reflected light from the real original is introduced into a photosensitive drum which is rotated in synchronization with the illumination and scanning. As a result, the photosensitive drum is exposed. The surface of the photosensitive drum before the exposure is uniformly charged by a charger. An electrostatic latent image corresponding to the real original is formed on the surface of the photosensitive drum by selective charge elimination caused by the exposure.

The formed electrostatic latent image is developed into a toner image by a developing device to which toner is supplied from a toner hopper. The toner image is transferred onto copy paper by corona discharges in a transferring corona discharger. The copy paper on which the toner image has been transferred is introduced into a fixing device, where the toner is fixed to the copy paper, thereby completing copying.

An attempt to stably obtain an image high in quality in the above described electrostatic copying machine brings about the necessity of suitably adjusting the image forming conditions such as the amount of exposure and the amount of charge of the photosensitive drum, the developing bias and the amount of toner to be supplied to the developing device.

The image forming conditions are adjusted for each predetermined period, for example, at the time of maintenance. In adjusting the image forming conditions, a pure white or solid black pseudo original (a reference density original) which is arranged in a region other than a region where the real original is illuminated and scanned is experimentally illuminated, and a toner image corresponding to the pseudo original is formed. At this time, the amount of exposure, the surface potential, the density of the toner image on the surface of the photosensitive drum, and the like are detected, and the image forming conditions are automatically adjusted on the basis of the results of the detection. Specifically, where the pure white pseudo original is illuminated to form a toner image, if so-called fog is detected on the basis of the detected toner image density, the amount of exposure is increased. On the other hand, where the solid black pseudo original is illuminated to form a toner image, if it is judged that the density is insufficient on the basis of the results of the detection of the toner image density, toner is automatically supplied to the developing device from the toner hopper.

A reflection type photosensor which is constituted by a pair of a light emitting element and a light receiving element arranged opposed to the photosensitive drum is generally applied to the detection of the density of the toner image on the surface of the photosensitive drum. Specifically, light of a previously set amount is irradiated onto the photosensitive drum from the light emitting element, and the amount of light received by the light receiving element which corresponds to the amount of light reflected from the photosensitive drum is detected. Since the amount of the reflected light corresponds to the density of the toner image on the surface of the photosensitive drum, it is possible to detect the density of the toner image on the surface of the photosensitive drum if the amount of received light is detected.

The amount of light irradiated onto the photo sensitive drum is set to either an amount for low density or an amount for high density, for example. The amount for low density is relatively small, while the amount for high density is relatively large. The amount for low density is applied for fog detection and the amount for high density is applied for solid black detection.

A toner image density used for adjusting the image forming conditions is detected by illuminating the pseudo original, as described above. On the other hand, the amount of reflected light differs due to mechanical factors or the like of the electrophotographic copying machine between a case where the pseudo original is illuminated and a case where the real original is illuminated and scanned. The factors of the difference in the amount of reflected light include the difference in the set position, the difference in color, and the difference in the positional relationship with a light modulating plate between the pseudo original and the real original.

For example, in the electrostatic copying machine, if the pseudo original is arranged in a position closer to the photosensitive drum, as compared with the real original, the amount of reflected light in a case where the pseudo original is illuminated becomes smaller than that in a case where the real original is illuminated. The reason for this is that a light source for illuminating and scanning the real original is generally designed so that light to be irradiated is converged on the surface of the real original.

Consequently, a toner image density corresponding to a pure white region of the real original is lower than a toner image density corresponding to the pseudo original on which a pure white image is formed. Hence, even under the image forming conditions (for example, the amount of exposure) properly adjusted so that fog is removed in the toner image density corresponding to the real original, a toner image of relatively high density may be formed when the pseudo original is illuminated. Thus, in fog detection by detecting the density of the toner image corresponding to the pseudo original, the density of the toner image may not always be detected correctly even with light of the amount for low density irradiated onto the photoreceptor from the reflection type photo sensor. In some machines, the amount for high density may be preferable for fog detection utilizing the pseudo original. The image forming conditions cannot be effectively adjusted unless the density of the toner image corresponding to the pseudo original is accurately detected.

SUMMARY OF THE INVENTION

An object of the present invention is to provide a method of adjusting a density detecting device so that the density of a toner image corresponding to a pseudo original can be detected when detecting fog utilizing the pseudo original.

Another object of the present invention is to provide an apparatus for adjusting a density detecting device so that the density of a toner image corresponding to a pseudo original can be detected when detecting fog utilizing the pseudo original.

According to the present invention, a real original is illuminated by a predetermined amount of illuminating light, whereby a toner image corresponding to the real original is formed on a photoreceptor. Light of an amount for low density for detecting a toner image density in a low-density region is irradiated onto the toner image corresponding to the real original on the photoreceptor from a density detecting device, to acquire density data outputted by the density detecting device at this time. In addition, a pseudo original is illuminated by the predetermined amount of illuminating light, whereby a toner image corresponding to the pseudo original is formed on the photoreceptor. Light of the amount for low density is irradiated onto the toner image corresponding to the pseudo original on the photoreceptor from the density detecting device, to acquire density data outputted by the density detecting device at this time.

The difference between the respective density data outputted by the density detecting device with respect to the toner images respectively corresponding to the real original and the pseudo original is compared with a predetermined threshold value. If the difference between the density data is less than the threshold value, the amount of light for low density is selected as an amount of light to be irradiated for fog detection. If the difference between the density data is not less than the threshold value, an amount of light for high density for detecting a toner image density in a high-density region is selected as the amount of light to be irradiated for fog detection.

The density data outputted by the density detecting device corresponds to the density of the toner image formed on the photoreceptor. Consequently, the difference between the respective density data outputted when the real original and the pseudo original are illuminated corresponds to the difference between the density of the toner image corresponding to the real original and the density of the toner image corresponding to the pseudo original. According to the present invention, therefore, it is judged whether or not the difference in the density is less than a predetermined difference in the density.

If the difference in the density is less than the predetermined difference in the density, the density of the toner image corresponding to the pseudo original can be regarded as that in a relatively low-density region. Consequently, the amount of light for low density is selected as the amount of light for fog detection in accordance with the present invention, thereby making it possible to detect fog with high precision. On the other hand, if the difference in the density is not less than the predetermined difference in the density, the density of the toner image corresponding to the pseudo original can be regarded as that in a relatively high-density region. Consequently, the amount of light for high density is selected as the amount of light for fog detection in accordance with the present invention, thereby making it possible to detect fog with high precision.

According to the present invention, it is determined which of the amount of light (for low density or for high density) is the one to be irradiated for fog detection on the basis of the difference in the density between the toner images respectively corresponding to the real original and the pseudo original. Therefore, it is possible to detect fog by the amount of light to be irradiated for fog detection corresponding to the mechanical conditions of the image forming apparatus. Even when the image forming conditions are adjusted on the basis of the density of the toner image corresponding to the pseudo original, therefore, it is possible to reliably prevent fog from being generated in the image corresponding to the real original. Therefore, it is possible to stably obtain an image high in quality.

It is preferable that the amount of light in a case where the real original and the pseudo original are illuminated is adjusted so that the density detecting device for irradiating light of the amount for low density outputs density data approximately equal to predetermined reference density data with respect to the toner image corresponding to the real original. In this case, comparison of the difference between the density data with the predetermined threshold value can be substituted by comparison of the density data outputted by the density detecting device with respect to the toner image corresponding to the pseudo original with a predetermined threshold value for the pseudo original determined on the basis of the reference density data. The reason for this is that when the density data corresponding to the real original is equal to the reference data, the density data corresponding to the pseudo original has a one-to-one correspondence with the difference between the density data respectively corresponding to the real original and the pseudo original.

If the density data outputted with respect to the toner image corresponding to the pseudo original takes a value of less than the threshold value for the pseudo original, the amount of light for low density may be selected as the amount of light to be irradiated for fog detection. On the other hand, when the density data outputted with respect to the toner image corresponding to the pseudo original takes a value of not less than the threshold value for the pseudo original, the amount of light for high density may be selected as the amount of light to be irradiated for fog detection.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
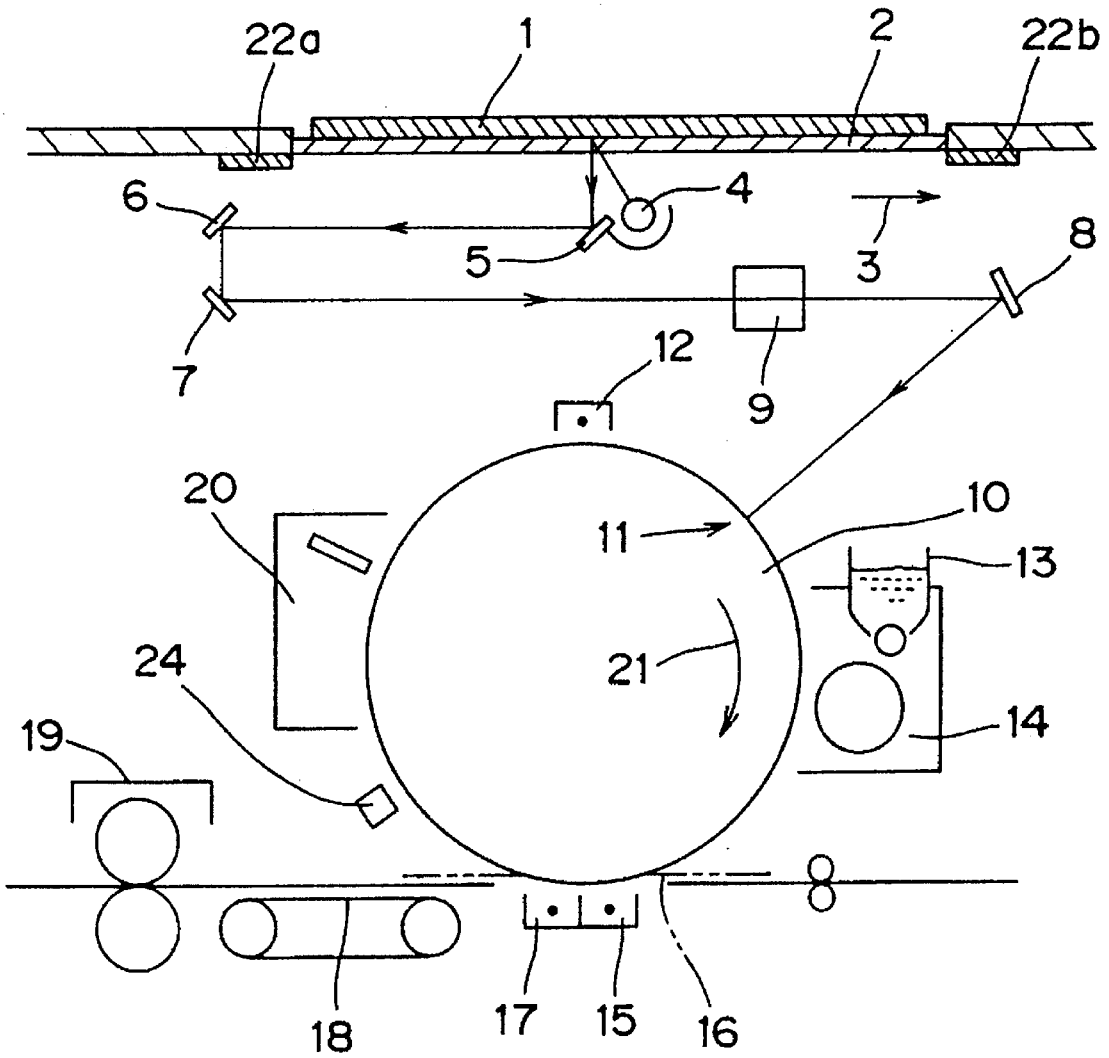
FIG. 1 is a conceptual diagram showing the schematic construction of an electrostatic copying machine having a density detecting device to which an adjusting method according to one embodiment of the present invention is applied.

FIG. 1 is a conceptual diagram showing the schematic construction of an electrostatic copying machine having a density detecting device to which an adjusting method according to one embodiment of the present invention is applied. There is provided, below a transparent platen 2 composed of transparent glass on which a real original 1 is to be put, a light source 4 for illuminating and scanning the surface of the real original 1 put on the transparent platen 2. The light source 4 is composed of a halogen lamp or the like, which is conveyed at predetermined speed in a direction indicated by an arrow 3 at the time of an image forming operation.

Reflected light from the original is introduced into an exposure region 11 on the surface of a photosensitive drum 10, guided by reflecting mirrors 5, 6, 7 and 8 and going through a zoom lens 9. On the other hand, the surface of the photosensitive drum 10 before reaching the exposure region 11 is uniformly charged by a charging corona discharger 12. As a result, an electrostatic latent image corresponding to the real original 1 is formed on the surface of the photosensitive drum 10.

At the time of the image forming operation, the reflecting mirror 5, along with the light source 4, is conveyed, and the reflecting mirrors 6 and 7 are convened in the direction indicated by the arrow 3 at a speed which is one-half the speed of conveyance of the light source 4. The photosensitive drum 10 is rotated and driven in a direction indicated by an arrow 21 in synchronization with the movement of the light source 4.

The electrostatic latent image formed on the surface of the photosensitive drum 10 is developed into a toner image by a developing device 14 to which toner is supplied from a toner hopper 13. The developed toner image is transferred onto the surface of copy paper 16 at a transferring corona discharger 15. The copy paper 16 on which the toner image has been transferred is separated from the photosensitive drum 10 by a separating corona discharger 17, and then is introduced into a fixing device 19 by a conveying belt 18. In the fixing device 19, the toner is fixed by heating on the surface of the copy paper 16, thereby completing copying.

The toner remaining on the surface of the photosensitive drum 10 after the transfer of the toner image is removed by a cleaning device 20, to prepare for the subsequent copying.

Pseudo originals **22*a* and 22*b* which are density reference originals on which a pure white image and a solid black image are formed are respectively provided on both sides of the transparent platen 2 and inside the main body of the copying machine. The pseudo originals 22*a* and 22*b* are used in adjusting the density of an image to be formed on copy paper 16**, as described later.

Furthermore, a reflection type photosensor 24 constituting a part of a density detecting device 23 as described below is provided so as to be opposed to the photosensitive drum 10 in a position in the vicinity of the photosensitive drum 10 between the separating corona discharger 17 and the cleaning device 20.

Figure 2:
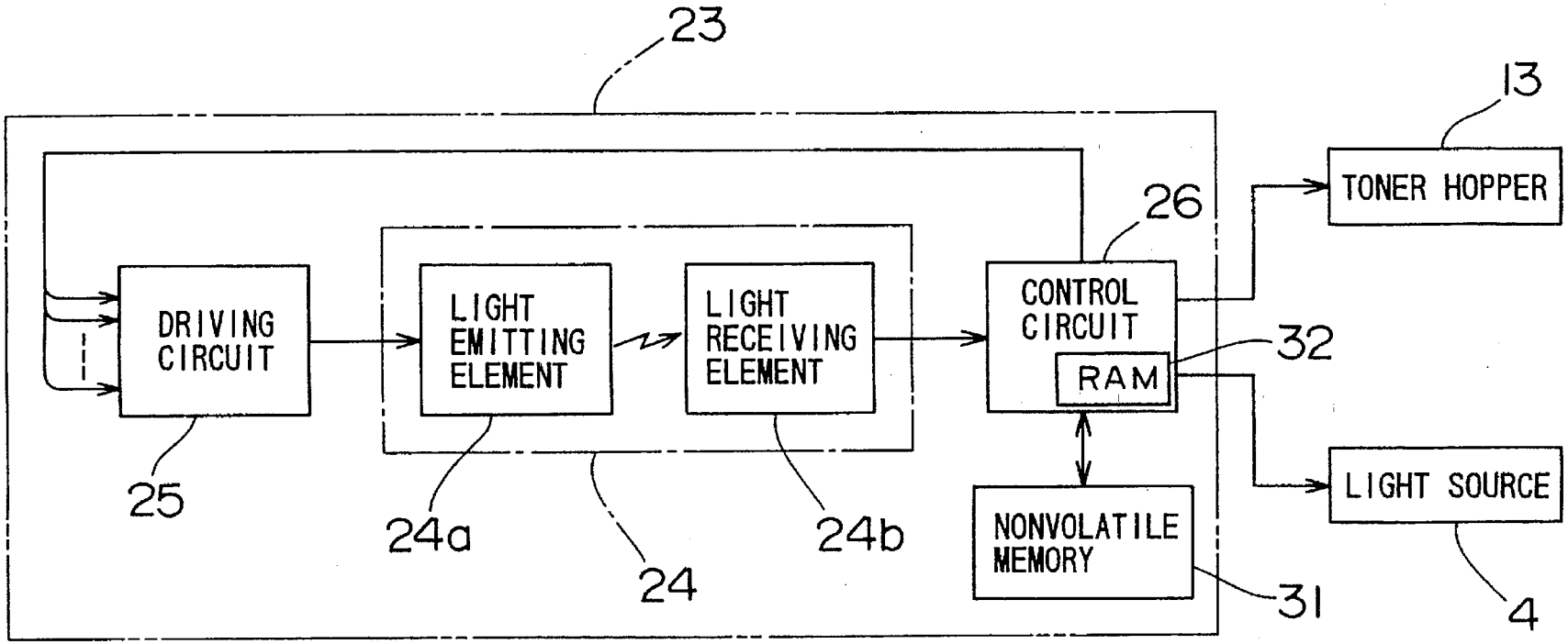
FIG. 2 is a block diagram showing the electrical construction of the density detecting device.

FIG. 2 is a block diagram showing the electrical construction of the density detecting device 23. The density detecting device 23 is made use of at the time of image forming condition adjusting processing as described later in order to adjust the density of an image to be formed on copy paper 16. At the time of the image forming condition adjusting processing, either of the pseudo originals **22*a* or 22*b* is experimentally illuminated, thereby to form a toner image having a density corresponding to the pseudo original on the photosensitive drum 10. The density of the formed toner image is detected by the density detecting device 23, and the image forming conditions such as the amount of exposure and the amount of toner to be supplied to the developing device 14** are adjusted on the basis of the results of the detection.

As described above, the density detecting device 23 includes the reflection type photosensor 24. The reflection type photosensor 24 includes a light emitting element **24*a* composed of a light emitting diode (LED) for irradiating light of a predetermined amount onto the photosensitive drum 10, for example, and a light receiving element 24*b* composed of a Darlington type phototransistor for receiving light reflected from the photosensitive drum 10, for example, and is driven by a driving circuit 25**.

A code represented by a binary code corresponding to a voltage to be supplied to the light emitting element **24*a* is fed from a control circuit 26 to the driving circuit 25. The control circuit 26 generates the code corresponding to the voltage to be applied to the light emitting element 24*a* in accordance with a predetermined program. The driving circuit 25 applies a voltage corresponding to the fed code to the light emitting element 24*a*. Consequently, light of an amount corresponding to the voltage is irradiated onto the photosensitive drum 10**.

A part of the light irradiated onto the photosensitive drum 10 is reflected from the surface of the photosensitive drum 10, and the remaining part is absorbed by toner on the surface of the photosensitive drum 10. Consequently, light of a relatively large amount is reflected if a toner image density is relatively low, while light of a relatively small amount is reflected if the toner image density is relatively high.

The above described reflected light is received by the light receiving element **24*b*. The light receiving element 24*b* generates density data inversely proportional to the amount of the reflected light and feeds the generated density data to the control circuit 26. That is, density data corresponding to the toner image density is fed to the control circuit 26**.

The above described control circuit 26 is constituted by a microcomputer having a CPU (Central Processing Unit), a RAM (Random Access Memory) 32 and a ROM (Read-only Memory), for example, and has the function of performing initialization processing and image forming condition adjusting processing as described later on the basis of the density data outputted from the light receiving element **24*b*. A programmable nonvolatile memory 31 for storing data related to the input-output characteristics of the reflection type photosensor 24 is connected to the control circuit 26. The nonvolatile memory 31** may be composed of a RAM with a backup power supply or an EEPROM (Electrically Erasable and Programmable ROM), for example.

Figure 3:
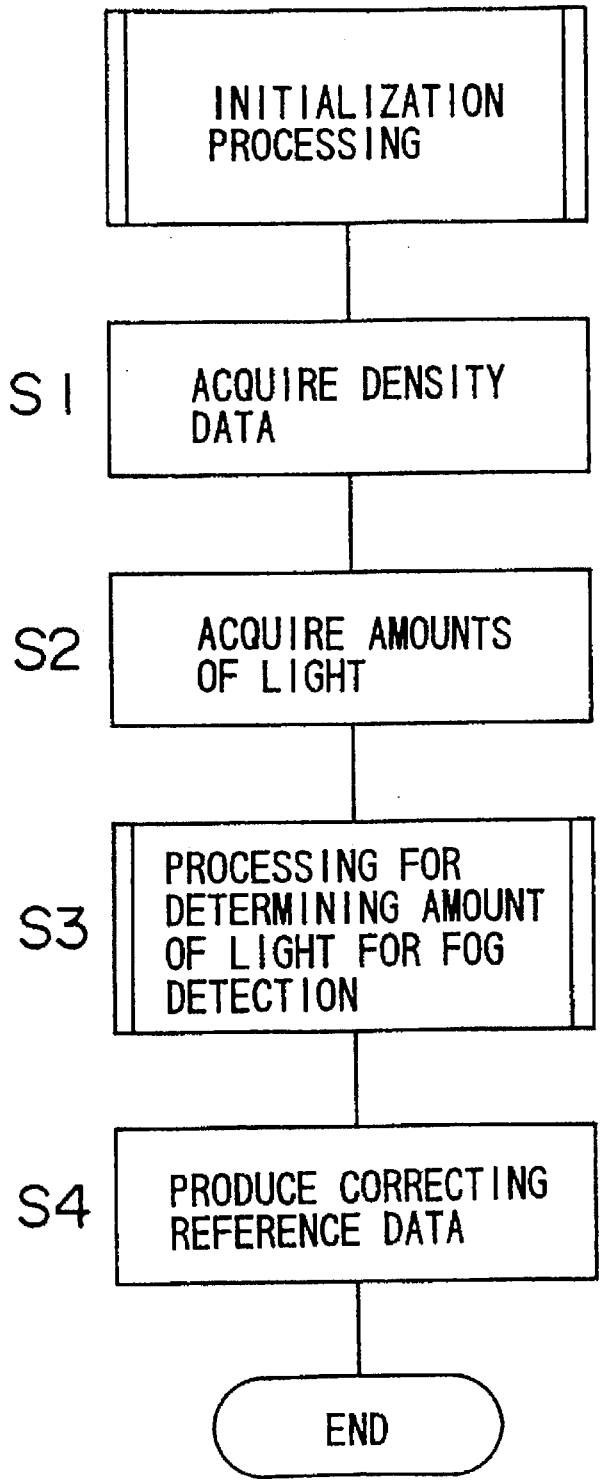
FIG. 3 is a flow chart for explaining initialization processing in the electrostatic copying machine.

FIG. 3 is a flow chart for explaining initialization processing performed before the copying machine is used by a user. In the initialization processing, density data is first acquired (step S1).

More specifically, light of the maximum amount $L_{max}$ and light of the minimum amount $L_{min}$ out of predetermined amounts L in a plurality of steps are irradiated onto the photosensitive drum 10 from the light emitting element **24*a* in the reflection type photosensor 24 in a state where the photosensitive drum 10** which has not been developed (that is, on which no toner adheres) stands still. Density data $D_{smin}$ and $D_{smax}$ respectively corresponding to reflected light in cases where light of the maximum amount $L_{max}$ and light of the minimum amount $L_{min}$ are irradiated are acquired.

Light of the amounts L incremented for each step successively from the minimum amount $L_{min}$ is irradiated onto the photosensitive drum 10 from the light emitting element 24*a*. Consequently, a plurality of density data $D_s$ respectively corresponding to the amounts of light L in a plurality of steps are acquired. In incrementing the amounts of light L for each step to acquire the density data $D_s$ in the step, it is examined whether or not the density data $D_s$ satisfies the following expression (1):

$$D_s < D_{smin} + V_0 \quad (1)$$

where $V_0$=0.2 (V), for example.

If the foregoing expression (1) is satisfied, the amount of light L in a step immediately before the expression is satisfied is taken as a reference amount of light $L_0$, and density data $D_s$ obtained in the case of the reference amount of light $L_0$ is taken as density data $D_s1$. That is, the maximum amount of light satisfying $D_s \geqq D_{smin}+V_0$ is the reference amount of light $L_0$. Where $D_s<D_{smin}+V_0$, an output of the reflection type photosensor 24 is saturated. Even if the amount of light to be irradiated is increased after the condition is satisfied, the density data $D_s$ hardly changes. Consequently, the reference amount of light $L_0$ is an amount of light slightly lower than the amount of light for which the output of the sensor 24 is saturated. The above described constant $V_0$ is determined by experiments so that an amount of light for which the output of the sensor 24 sufficiently in changes with the change in density is set to the reference amount of light $L_0$.

The photosensitive drum 10 is then rotated, and light in the reference amount $L_0$ is irradiated from the light emitting element 24*a* onto the photosensitive drum 10 which is rotated. At this time, the light emitting element 24*a* emits light a plurality of times while the photosensitive drum 10 is being rotated once. The average of the plurality of density data $D_s$ acquired at this time is found as average density data $D_{sav}$. The plurality of density data $D_s$ respectively acquired by irradiating light of the amounts L in a plurality of steps onto the photosensitive drum 10 in the still state are corrected on the basis of the average density data $D_{sav}$, the density data $D_s1$ corresponding to the reference amount of light $L_0$ and the density data $D_{smax}$ corresponding to the maximum amount of light $L_{max}$. Specifically, density data $D_s'$ after the correction are given by the following equation (2):

$$D_s' = D_s(D_{smax}-D_{sav})/(D_{smax}-D_s1)+D_{smax}(D_{sav}-D_s1)/(D_{smax}-D_s1) \quad (2)$$

Consequently, suitable density data considering the variation in the circumferential direction of the photosensitive drum 10 are obtained.

Density data are thus acquired in each of sections over the periphery of the photosensitive drum 10 with respect to only the reference amount of light $L_0$ out of the amounts of light L in a plurality of steps. Consequently, time required to acquire density data can be shortened, as compared with that in a case where density data are acquired in each of the sections over the periphery of the photosensitive drum 10 with respect to the amounts of light L in all the steps. Moreover, the total amount of light irradiated onto the photosensitive drum 10 is small, thereby making it possible to reduce the light-induced fatigue of the photosensitive drum 10.

When the density data is acquired, a first amount of light for low density $LN_1$ and a first amount of light for high density $LX_1$ are found (step S2). Specifically, an amount of light corresponding to the minimum density data $D_s'$ which satisfies the following expression (3) out of the density data $D_s'$ after the correction (the maximum amount of light satisfying the following expression (3)) is taken as the first amount of light for low density $LN_1$:

$$D_s' \geqq D_{smin} + V_0' \quad (3)$$

where $V_0'$=0.4 (V), for example.

It is preferable that the density data Ds' which does not satisfy the foregoing expression (3) is not used because it is data in a region where the output of the sensor 24 is saturated. The above described constant $V_0'$ is determined by experiments so that an amount of light for which the output of the sensor 24 can sufficiently change with the change in density becomes the first amount of light for low density $LN_1$.

On the other hand, the first amount of light for high density $LX_1$ is found by substituting the first amount of light for low density $LN_1$ found as described above in a predetermined conversion equation.

For example, when the amounts of light L are set in 64 steps from 0 to 63, the first amount of light for high density $LX_1$ may be found by substituting the first amount of light for low density $LN_1$ in the following conversion equations:

$$\text{Where } LN_1=0 \text{ to } 15,\ LX_1=2LN_1+2 \quad (4)$$

$$\text{Where } LN_1=16 \text{ to } 23,\ LX_1=0.108(LN_1)^2-0.28LN_1+11 \quad (5)$$

If $LN_1$>23, the amount of light for high density $LX_1$ must take a value of not less than 64, whereby the setting becomes impossible. In such a case, it is considered that any abnormality occurs in the density detecting device 23.

In producing the above described conversion equations, suitable values of the first amount of light for high density $LX_1$ are respectively found by experiments with respect to a plurality of values of the first amount of light for low density $LN_1$. The above described conversion equations are determined so that the results of the experiments are approximated.

For example, a density intermediate between the density of a toner image on the photosensitive drum 10 which has not been developed and the density of a solid black toner image is referred to as an intermediate density. It is preferable that the amount of light for low density LN is set so that the output of the reflection type photosensor 24 reaches the maximum (the top) at the intermediate density. On the other hand, it is preferable that the amount of light for high density LX is set so that the output of the reflection type photosensor 24 rises at the intermediate density and reaches the maximum (the top) where the image is solid black.

At the time of image forming condition adjusting processing as described later, a second amount of light for low density $LN_2$ is found similarly to the first amount of light for low density $LN_1$, and a second amount of light for high density $LX_2$ is found similarly to the first amount of light for high density $LX_1$. The second amount of light for low density $LN_2$ or the second amount of light for high density $LX_2$ is used for detecting fog, and the second amount of light for high density $LX_2$ is used for detecting a solid black. It is determined, in processing for determining an amount of light to be irradiated for fog detection, which of the second amount of light for low density $LN_2$ and the second amount of light for high density $LX_2$ is used for detecting fog (step S3).

In detecting a toner image density corresponding to the pseudo originals 22*a* and 22*b* at the time of image forming condition adjusting processing as described later, when the second amount of light for low density $LN_2$ is set, the input-output characteristics of the reflection type photosensor 24 are not so different from the input-output characteristics in a case where the first amount of light for low density $LN_1$ is set at the time of the initialization. When the second amount of light for low density $LN_2$ is set to detect the toner image density, therefore, it is safe to refer to the input-output characteristics of the sensor 24 in a case where the first amount of light for low density $LN_1$ is set at the time of the initialization. On the other hand, the input-output characteristics of the sensor 24 in a case where the second amount of light for high density $LX_2$ is set at the time of the image forming condition adjusting processing significantly deviate from the input-output characteristics of the sensor 24 in a case where the first amount of light for high density $LX_1$ is set at the time of the initialization. The reason for this is that the amounts of light for low density $LN_1$ and $LN_2$ are set on the basis of the actual results of the density detection, while the amounts of light for high density $LX_1$ and $LX_2$ are found by substituting the amounts of light for low density $LN_1$ and $LN_2$ in conversion equations. That is, a suitable relationship between the amount of light for low density and the amount of light for high density differs between the time of the initialization and the time of the image forming condition adjusting processing. Toner and paper particles adhering onto a light emitting surface and a light receiving surface of the reflection type photosensor 24 are the main cause.

When the second amount of light for high density $LX_2$ is set at the time of the image forming condition adjusting processing, therefore, the input-output characteristics of the reflection type photosensor 24 in a case where the first amount of light for high density $LX_1$ is set at the time of the initialization processing cannot be referred to as they are. In the initialization processing according to the present embodiment, therefore, correcting reference data $D_{ST}$ for correcting the density data outputted from the reflection type photosensor 24 in which the second amount of light for high density $LX_2$ is set at the time of the image forming condition adjusting processing is found (step S4).

More specifically, the first amount of light for low density $LN_1$ is first set in the reflection type photosensor 24. The pseudo original 22*a* is illuminated while varying the amount of illuminating light from the light source 4, whereby a toner image forming operation is performed. Consequently, a toner image having a plurality of regions which differ in density is formed on the surface of the photosensitive drum 21. The density in each of the regions of the toner image is detected by the reflection type photosensor 24, and density data outputted by the sensor 24 is acquired for each region. The actual density of the toner image corresponds to the amount of exposure corresponding to each of the regions, thereby to obtain a low-density set light amount characteristic curve representing the relationship between a toner image density and density data. In the low-density set light amount characteristic curve, a toner image density corresponding to predetermined first density data $D_0$ is acquired as a first reference density $ID_0$.

The first amount of light for high density $LX_1$ is then set in the reflection type photosensor 24. Similarly to the foregoing, the pseudo original 22*a* is illuminated while varying the amount of illuminating light from the light source 4, whereby a toner image forming operation is performed. Consequently, a high-density set light amount characteristic curve representing the relationship between a toner image density and density data in a case where the first amount of light for high density $LX_1$ is set is obtained. In this high-density set light amount characteristic curve, density data corresponding to the first reference density $ID_0$ is taken as the correcting reference data $D_{ST}$.

The low-density set light amount characteristic curve and the high-density set light amount characteristic curve are stored in the nonvolatile memory 31, and are made use of at the time of the image forming condition adjusting processing.

Consequently, the initialization processing is achieved.

Figure 4:
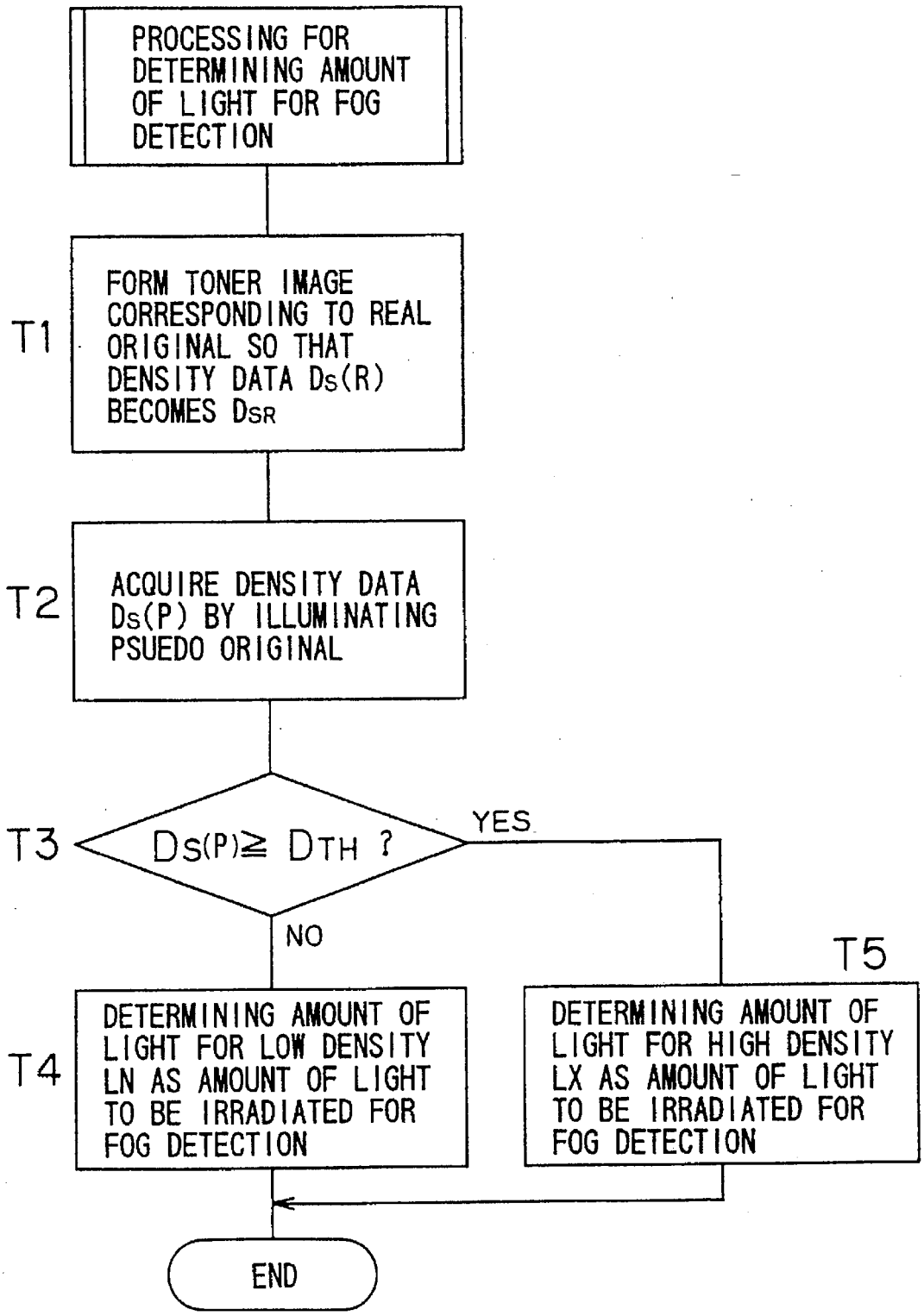
FIG. 4 is a flow chart for explaining processing for determining an amount of light to be irradiated for fog detection in the electrostatic copying machine.

FIG. 4 is a flow chart for explaining the above described processing for determining an amount of light to be irradiated for fog detection. In the processing for determining an amount of light to be irradiated for fog detection, a toner image corresponding to a real original 1 on the photosensitive drum 10 is formed so that the density data $D_s$ outputted from the reflection type photosensor 24 becomes predetermined reference data $D_{SR}$ (step T1).

More specifically, a real original 1 on which a pure white image is formed is put on the transparent platen 2, and the real original 1 is illuminated and scanned by a predetermined amount of illuminating light. Consequently, an electrostatic latent image corresponding to the real original 1 is formed on the photosensitive drum 10, whereby the toner image corresponding to the real original 1 is formed on the photosensitive drum 10 by the developing device 14.

On the other hand, the reflection type photosensor 24 irradiates light of the first amount for low density $LN_1$ acquired in the step S2 of the initialization processing onto the photosensitive drum 10 on which the toner image corresponding to the real original 1 is formed. Correspondingly, density data $D_s(R)$ corresponding to the density of the toner image corresponding to the real original 1 is fed from the reflection type photosensor 24 to the control circuit 26 in the density detecting device 23.

In the control circuit 26, it is judged whether or not the density data $D_s(R)$ outputted from the reflection type photosensor 24 takes a value within a predetermined very small range (for example, $D_{SR}\pm0.04$ V) centered around the reference data $D_{SR}$. As a result, if it is judged that the density data $D_s(R)$ does not take a value within the predetermined very small range, the light source 4 is controlled so that the amount of illuminating light is increased or decreased. The real original 1 is illuminated and scanned again by light of the increased or decreased amount, whereby a toner image forming operation is performed.

Such an operation is repeatedly performed until the density data $D_s(R)$ takes a value within the predetermined very small range centered around the reference data $D_{SR}$ in the control circuit 26.

The above described reference data $D_{SR}$ is determined in the following manner. Specifically, the reference data $D_{SR}$ is found as a value larger than the minimum density data $D_{smin}$ acquired in the step S1 of the initialization processing by $\alpha$ (for example, $\alpha$=0.2 to 0.3 (V)), that is:

$$D_{SR}=D_{smin}+\alpha+V_0' \quad (4)$$

The reason why the reference data $D_{SR}$ is thus determined is that the density data $D_s$ outputted by the reflection type photosensor 24 is saturated when it is not more than the minimum density data $D_{smin}$, so that it is preferable that a value sufficiently larger than $D_{smin}$ is taken as the reference data $D_{SR}$, as described above.

In the processing for determining the amount of light for fog detection, the pseudo original 22*a* on which a pure white image is formed is illuminated by illuminating light of an amount for which the density data $D_s(R)$ takes a value within the very small range centered around the reference data $D_{SR}$, whereby a toner image forming operation is performed. Consequently, an electrostatic latent image corresponding to the pseudo original 22*a* is formed on the photosensitive drum 10, whereby a toner image corresponding to the pseudo original 22*a* is formed on the photosensitive drum 10 by the developing device 14.

On the other hand, in the reflection type photosensor 24, light of the first amount for low density $LN_1$ is irradiated onto the photosensitive drum 10 on which the toner image corresponding to the pseudo original 22*a* is formed. Consequently, density data $D_s(P)$ corresponding to the toner image corresponding to the pseudo original 22*a* is fed to the control circuit 26 in the density detecting device 23 from the reflection type photosensor 24 (step T2).

In the control circuit 26, it is judged whether or not the fed density data $D_s(P)$ is not less than a predetermined threshold value $D_{TH}$ (for example, $D_{TH}$=3.9 (V)) (step T3). As a result, if the density data $D_s(P)$ is less than the threshold value $D_{TH}$, the amount of light for low density LN is determined as the amount of light to be irradiated for fog detection (step T4). Specifically, at the time of the image forming condition adjusting processing, the second amount of light for low density $LN_2$ is set in the reflection type photosensor 24. If the density data $D_s(P)$ is not less than the threshold value $D_{TH}$, the amount of light for high density LX is determined as the amount of light to be irradiated for fog detection (step T5). Specifically, at the time of the image forming condition adjusting processing, the second amount of light for low density $LN_2$ is set in the reflection type photosensor 24.

The reason why it is appropriate to determine the amount of light to be irradiated for fog detection in such way will be described.

Figure 5:
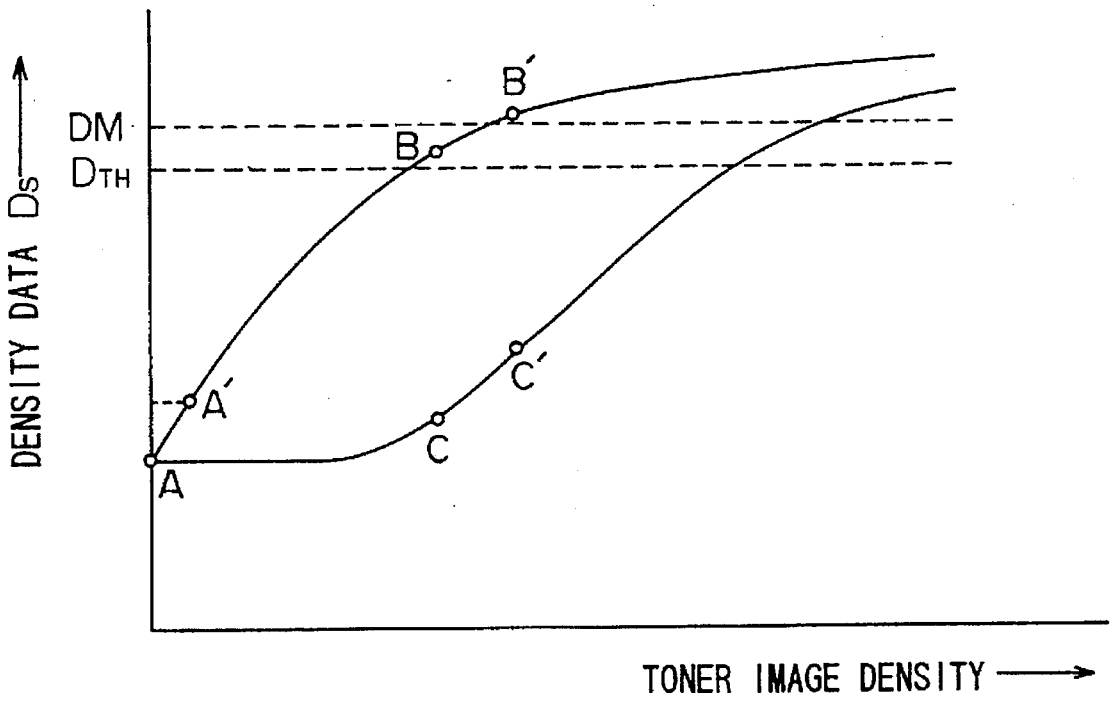
FIG. 5 is a diagram for explaining the basis for judgment as to which of an amount of light for low density and an amount of light for high density is taken as an amount of light to be irradiated for fog detection in the processing for determining an amount of light to be irradiated for fog detection.

FIG. 5 is a diagram showing a density data curve outputted from the reflection type photosensor 24. Referring to FIG. 5, the reason why the processing in the steps T4 and T5 shown in FIG. 4 is performed on the basis of the results of the judgment in the step T3 shown in FIG. 4 will be described.

In FIG. 5, points A and A' indicate density data $D_s(R)$ outputted from the reflection type photosensor 24 when light in the first amount for low density $LN_1$ is irradiated from the reflection type photosensor 24 in a case where the real original 1 is illuminated and scanned by a predetermined amount of illuminating light. Points B and B' indicate density data $D_s(P)$ outputted from the reflection type photosensor 24 when light in the first amount for low density $LN_1$ is irradiated from the reflection type photosensor 24 in a case where the pseudo original 22*a* is illuminated by the same predetermined amount of illuminating light as the foregoing. Points C and C' indicate density data $D_s(P)$ outputted from the reflection type photosensor 24 when light in the first amount for high density $LX_1$ is irradiated from the reflection type photosensor 24 in a case where the pseudo original 22*a* is illuminated by the same predetermined amount of illuminating light as the foregoing.

The point A' corresponds to the upper-limit value of the range of densities set for fog detection in a case where the real original 1 is illuminated and scanned. The points B' and C' correspond to the upper-limit values of the range of densities set for fog detection in a case where the pseudo original 22*a* is illuminated. The range of densities set for fog detection is the range of toner image densities in a case where fog is detected.

On the other hand, density data DM (for example, DM=4.4 (V)) indicates the upper-limit value of the available range of the reflection type photosensor 24 which is determined by the characteristics of the sensor 24. That is, if the density data $D_s$ outputted from the reflection type photosensor 24 takes a value of not less than the upper-limit value DM, the toner image density cannot be detected. Therefore, the density data $D_S$ at the points B' and C' must take values of less than the upper-limit value DM in a case where fog is detected.

In FIG. 5, the density data $D_S$ at the points C' does not take a value of not less than the upper-limit value DM even at a toner image density at which the density data $D_S$ at the point B' takes a value of not less than the upper-limit value DM. If the density data $D_S$ at the point B' takes a value of not less than the upper-limit value DM, therefore, it is favorable in terms of fog detection that an amount of light to be irradiated at the point C', that is, the first amount of light for high density $LX_1$ is employed as the amount of light to be irradiated for fog detection.

It has been found by experiments that the density data $D_S$ at the point B must take a value of less than the threshold value $D_{TH}$, in order for the density data $D_S$ at the point B' to take a value of less than the upper-limit value DM. The first amount of light for low density $LN_1$ is selected as the amount of light to be irradiated for fog detection if the density data $D_s(P)$ outputted with respect to the pseudo original 22*a* from the reflection type photosensor 24 in which the first amount of light for low density $LN_1$ is set takes a value of less than the threshold value $D_{TH}$, while the amount of light for high density LX is selected as the amount of light to be irradiated for fog detection if the density data $D_s(P)$ takes a value of not less than the threshold value $D_{TH}$.

As described in the foregoing, the amount of exposure in which the density data corresponding to the real original 1 becomes $D_{SR}$ is found, and a toner image corresponding to the pseudo original 22*a* is formed in this amount of exposure. Consequently, density data $D_s(P)$ corresponding to the pseudo original 22*a* obtained at this time corresponds to the difference between the density data respectively corresponding to the real original 1 and the pseudo original 22*a* with respect to the same amount of exposure. That is, the density data $D_s(P)$ corresponding to the pseudo original 22*a* is compared with the threshold value $D_{TH}$, whereby the difference between the density data respectively corresponding to the real original 1 and the pseudo original 22*a* is substantially compared with a predetermined threshold value.

Figure 6:
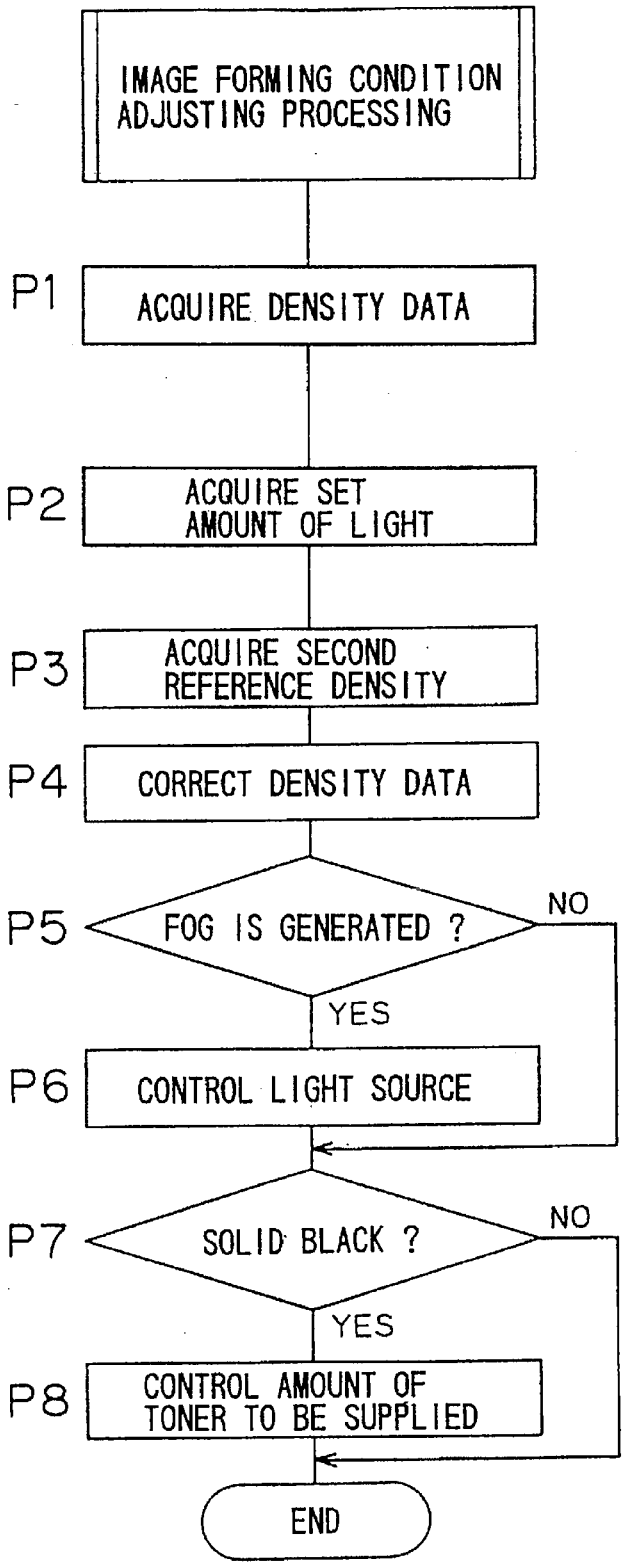
FIG. 6 is a flow chart for explaining image forming condition adjusting processing in the electrostatic copying machine.

FIG. 6 is a flow chart for explaining the image forming condition adjusting processing. The image forming condition adjusting processing is performed for each predetermined period (for example, every 60,000 copies), for example, at the time of maintenance. More specifically, the same processing as the density data acquiring processing and the set light amount acquiring processing in the initialization processing is first performed. On the basis of the processing, the second amount of light for low density $LN_2$ is found in the same manner as to find the first amount of light for low density $LN_1$, and the second amount of light for high density $LX_2$ is acquired in the same manner as to find the first amount of light for high density $LX_1$ (steps P1 and P2). A second reference density $ID_1$ is then found (step P3). The second reference density $ID_1$ is found in approximately the same manner as to find the first reference density $ID_0$. That is, density data slightly lower than the saturation point of the output of the reflection type photosensor 24 in which the second amount of light for low density $LN_2$ is set is taken as second density data $D_1$. In the second amount of light for low density $LN_2$, a toner image density corresponding to the second density data is taken as the second reference density $ID_1$. The second reference density $ID_1$ is approximately the same as the first reference density $ID_0$. The second density data $D_1$ takes a value within the range of precision of $\pm\alpha$ (for example, $\alpha$=0.02 (V)) with respect to the first density data $D_0$, that is, $D_0\pm\alpha$ (for example, $\alpha$=0.02 (V)).

When the second reference density $ID_1$ is found, density data outputted from the reflection type photosensor 24 in a case where the first amount of light for high density $LX_1$ is set in the reflection type photosensor 24 at the time of the initialization is corrected (step P4). That is, a plurality of density data $D_sDAT$ acquired with respect to toner images having densities in a plurality of steps in a state where the first amount of light for high density $LX_1$ is set at the time of the initialization processing are corrected. The density data $D_sDAT$ are data forming the above described high-density set light amount characteristic curve and are stored in the nonvolatile memory 31.

More specifically, the pseudo original 22*a* is first illuminated in an amount of exposure corresponding to the second reference density $ID_1$. A toner image having the second reference density $ID_1$ is formed on the surface of the photosensitive drum 10 by the function of the developing device 14 or the like. The density of the toner image having the second reference density $ID_1$ is detected by the reflection type photosensor 24 in which the second amount of light for high density $LX_2$ is set, and outputted density data is taken as second reference data $D_{SF}$.

If the second reference data $D_{SF}$ is found, a correction factor K is found by the following equation on the basis of the reference data $D_{SF}$ and the correcting reference data $D_{ST}$ found at the time of the initialization processing:

$$K=D_{ST}/D_{SF} \tag{5}$$

The plurality of density data $D_sDAT$ acquired at the time of the initialization processing are used in a form corrected on the basis of the correction factor K. That is, at the time of the image forming condition adjusting processing, the plurality of density data acquired at the time of the initialization are treated as density data $D_sDAT'$ after the correction indicated by the following equation (6). The data $D_sDAT'$ after the correction and the data $D_sDAT$ before the correction are stored in the RAM 32 in the control circuit 26 with the correspondence established therebetween.

$$D_sDAT'=K\times D_sDA \tag{6}$$

For example, the actual output data of the reflection type photosensor 24 corresponding to the reference density $ID_0$ is $D_{SF}$. Data after the correction corresponding to the density data $D_{SF}$ is as follows when it is calculated in accordance with the foregoing equation (6):

$$D_sDAT'=K\times D_{SF}=(D_{ST}/D_{SF})\times D_{SF}=D_{ST} \tag{7}$$

When the data $D_sDAT'$ ($=D_{ST}$) after the correction is regarded as data acquired at the time of the initialization processing, and is applied to the high-density set light amount characteristic curve acquired at the time of the initialization processing and stored in the nonvolatile memory 31, the toner image density $ID_0$ is obtained.

Even when the input-output characteristics corresponding to the second amount of light for high density $LX_2$ in the reflection type photosensor 24 thus differ from the input-output characteristics corresponding to the first amount of light for high density $LX_1$ at the time of the initialization, the toner image density can be accurately detected making use of the high-density set light amount characteristic curve obtained at the time of the initialization by the above described correction.

The second amount of light for low density $LN_2$ is suitably set on the basis of the actual results of the detection, whereby the input-output characteristics of the reflection type photosensor 24 are approximately the same between a case where the first amount of light for low density $LN_1$ is set at the time of the initialization and a case where the second amount of light for low density $LN_2$ is set at the time of the image forming condition adjusting processing. When the second amount of light for low density $LN_2$ is set, therefore, the low-density set light amount characteristic curve acquired at the time of the initialization processing can be used as it is without being corrected.

When the correction of the density data $D_sDAT$ is terminated (step P4), it is then determined whether or not fog is generated (step P5). Specifically, the pseudo original 22*a* on which a pure white image is formed is illuminated, and a toner image forming operation is performed. The amount of light to be irradiated onto the photosensitive drum 10 from the reflection type photosensor 24 is the set amount of light selected as the amount of light for fog detection in the initialization processing out of the second amount of light for low density $LN_2$ and the second amount of light for high density $LX_2$. It is determined whether or not fog is generated on the basis of the density data outputted from the reflection type photosensor 24.

As a result, when it is determined that fog is generated, the amount of light to be emitted from the light source 4 is increased (step P6).

A solid black is then detected (step P7). Specifically, the pseudo original 22*b* on which a solid black image is formed is illuminated, whereby a toner image corresponding to the pseudo original 22*b* is formed on the surface of the photosensitive drum 10. The density of the formed toner image is detected by the reflection type photosensor 24. At this time, the amount of light to be irradiated from the reflection type photosensor 24 is set to the second amount of light for high density $LX_2$. It is determined whether or not the toner image is solid black on the basis of the density data outputted from the reflection type photosensor 24.

As a result, if it is determined that the toner image is not solid black, the toner hopper 13 is controlled. Specifically, the amount of toner to be supplied to the developing device 14 from the toner hopper 13 is increased (step P8).

Consequently, the adjustment of the image forming conditions is achieved, thereby making it possible to stably acquire an image high in quality.

When the second amount of light for high density $LX_2$ is set, data which is closest to the data outputted from the reflection type photosensor 24 out of the density data $D_sDAT$ acquired at the time of the initialization is found out. Density data $D_sDAT'$ after the correction corresponding to the density data $D_sDAT$ found out is read out from the RAM 32 in the control circuit 26. Further, in the above described high-density set light amount characteristic curve, a toner image density corresponding to the read-out data $D_sDAT'$ after the correction is found out. The toner image density is regarded as the density of a toner image which is an object to be detected.

As a result, when the second amount of light for high density $LX_2$ is set in the reflection type photosensor 24, the data $D_s$ outputted from the reflection type photosensor 24 is corrected in accordance with the following equation (8). Data $D_s''$ after the correction is applied to the input-output characteristics at the time of the initialization, thereby to detect the toner image density.

$$D_s''=K\times D_s \tag{8}$$

As described in the foregoing, in the electrostatic copying machine according to the present embodiment, the amount of light to be irradiated for fog detection is determined on the basis of the difference between a toner image density acquired when the real original 1 is illuminated and scanned and a toner image density acquired when the pseudo original 22*a* is illuminated at the time of initialization processing. Consequently, it is possible to detect fog by an amount of light to be irradiated for fog detection corresponding to the mechanical conditions of the electrophotographic copying machine. Hence, since the density of the toner image corresponding to the pseudo original 22*a* can be accurately detected, the image forming conditions can be properly adjusted. Consequently, an image high in quality can be stably obtained.

Although the embodiment of the present invention was described, the present invention is not limited to the above described embodiment. For example, although in the above described embodiment, an electrostatic copying machine is taken as an example, the present invention is also applicable to an arbitrary image forming apparatus on which an image is formed by the electrophotographic process, for example, a laser beam printer or a facsimile.

Although in the above described embodiment, description was made of a case where the amount of light to be irradiated from the reflection type photosensor 24 is set to only two types of amounts, that is, an amount of light for low density and an amount of light for high density, the amount of light to be irradiated from the reflection type photosensor 24 may be set to three or more types. In this case, either one of the two amounts among them with the light of which amount the change in density in a relatively low-density region can be detected with high precision may be selected and used for fog detection.

Although the present invention has been described and illustrated in detail, it is clearly understood that the description is by way of illustration and example only and is not to be taken by way of limitation, the spirit and scope of the present invention being limited only by the terms of the appended claims.

What is claimed is:

1. A method of adjusting a density detecting device, provided for an image forming apparatus comprising a photoreceptor on which an electrostatic latent image corresponding to a real original or a pseudo original is formed and a developing device for developing the electrostatic latent image formed on the photoreceptor into a toner image, for irradiating light in a predetermined amount onto the photoreceptor and outputting data corresponding to an amount of light reflected from the photoreceptor as density data, the method comprising the steps of:

illuminating a real original by a predetermined amount of illuminating light, to form a toner image corresponding to the real original on the photoreceptor;

irradiating light of an amount for low density which is for detecting a toner image density in a low-density region onto the toner image corresponding to the real original formed on the photoreceptor from the density detecting device, to acquire a first density data outputted by the density detecting device;

illuminating a pseudo original by the predetermined amount of illuminating light, to form a toner image corresponding to the pseudo original on the photoreceptor;

irradiating light of the amount for low density onto the toner image corresponding to the pseudo original formed on the photoreceptor from the density detecting device, to acquire a second density data outputted by the density detecting device;

comparing a difference between the first density data outputted by the density detecting device with respect to the toner image corresponding to the real original and the second density data outputted by the density detecting device with respect to the toner image corresponding to the pseudo original with a predetermined threshold value;

selecting the amount of light for low density as an amount of light to be irradiated onto the photoreceptor from the density detecting device so as to detect fog if the difference between the first density data and the second density data is less than the threshold value; and selecting an amount of light for high density which is for detecting a toner image density in a high-density region as an amount of light to be irradiated onto the photoreceptor from the density detecting device so as to detect fog if the difference between the first density data and the second density data is not less than the threshold value.

2. The method according to claim 1, further comprising a step of adjusting the amount of illuminating light for illuminating the real original and the pseudo original so that the density detecting device which irradiates light of the amount for low density outputs density data approximately equal to predetermined reference density data with respect to the toner image corresponding to the real original.

3. The method according to claim 2, wherein said step of comparing the difference between the first and the second density data with the predetermined threshold value includes the step of comparing the second density data outputted by the density detecting device with respect to the toner image corresponding to the pseudo original with a threshold value for the pseudo original determined on the basis of the reference density data.

4. The method according to claim 3, wherein said step of selecting the amount of light for low density as the amount of light to be irradiated for fog detection includes the step of selecting the amount of light for low density as the amount of light to be irradiated for fog detection if the second density data outputted with respect to the toner image corresponding to the pseudo original is less than the threshold value for the pseudo original, and said step of selecting the amount of light for high density as the amount of light to be irradiated for fog detection includes the step of selecting the amount of light for high density as the amount of light to be irradiated for fog detection if the second density data outputted with respect to the toner image corresponding to the pseudo original is not less than the threshold value for the pseudo original.

5. The method according to claim 2, wherein the reference density data has a value larger by a predetermined value than a third density data which is outputted by the density detecting device irradiating light of a minimum amount onto the photoreceptor on which no toner adheres.

6. The method according to claim 1, wherein the density detecting device can irradiate light of amounts in a plurality of steps from the minimum amount to a maximum amount, and the amount of light for low density and the amount of light for high density are predetermined amounts of light out of the amounts of light in the plurality of steps.

7. The method according to claim 6, wherein the density detecting device outputs density data roughly inversely proportional to an amount of light reflected from the photoreceptor, and the amount of light for low density is determined by performing the steps of: irradiating light of amounts in a plurality of steps by the density detecting device onto the photoreceptor on which no toner adheres, finding out a maximum step of said plurality of steps in which data outputted by the density detecting device takes a value of not less than a predetermined value, and determining the amount of light in the maximum step as the amount of light for low density.

8. The method according to claim 7, wherein the amount of light for high density is an amount of light found by substituting the amount of light for low density in a predetermined conversion equation.

9. An apparatus for adjusting a density detecting device, provided for an image forming apparatus comprising a photoreceptor on which an electrostatic latent image corresponding to a real original or a pseudo original is formed and a developing device for developing the electrostatic latent image formed on the photoreceptor into a toner image, for irradiating light in a predetermined amount onto the photoreceptor and outputting data corresponding to the amount of light reflected from the photoreceptor as density data, the apparatus comprising:

means for setting either one of an amount of light for low density which is for detecting a toner image density in a low-density region or an amount of light for high density which is for detecting a toner image density in a high-density region as the amount of light to be irradiated onto the photoreceptor from the density detecting device;

a light source for illuminating either one of the real original or the pseudo original by a predetermined amount of light;

means for causing the light source to generate illuminating light of the predetermined amount to illuminate the real original, in order to form a toner image corresponding to the real original on the photoreceptor by said developing device;

means for detecting the density of the toner image corresponding to the real original on the photoreceptor by the density detecting device in which the amount of light for low density is set by the illuminating light amount setting means, to acquire a first density data outputted by the density detecting device;

means for causing the light source to generate illuminating light of the predetermined amount to illuminate the pseudo original, in order to form a toner image corresponding to the pseudo original on the photoreceptor by said developing device;

means for detecting the density of the toner image corresponding to the pseudo original on the photoreceptor by the density detecting device in which the amount of light for low density is set by the illuminating light amount setting means, to acquire a second density data outputted by the density detecting device;

comparing means for comparing a difference between the first density data outputted by the density detecting device with respect to the toner image corresponding to the real original and the second density data outputted by the density detecting device with respect to the toner image corresponding to the pseudo original with a predetermined threshold value; and selecting means for selecting, on the basis of a result of the comparison by the comparing means, either one of the amount of light for low density or the amount of light for high density as the amount of light to be irradiated onto the photoreceptor from the density detecting device for fog detection, the selecting means selecting the amount of light for low density if the difference between the first and the second density data is less than the threshold value, while selecting the amount of light for high density if the difference between the first and the second density data is not less than the threshold value.

10. The adjusting apparatus according to claim 9, wherein the predetermined amount of illuminating light is such an amount of light that density data approximately equal to predetermined reference density data is outputted when the density detecting device in which the amount of light for low density is set detects the density of the toner image corresponding to the real original.

11. The adjusting apparatus according to claim 10, wherein the comparing means compares the second density data outputted by the density detecting device with respect to the toner image corresponding to the pseudo original with a threshold value for the pseudo original determined on the basis of the reference density data.

12. The adjusting apparatus according to claim 11, wherein the selecting means selects the amount of light for low density as the amount of light to be irradiated for fog detection if the second density data outputted with respect to the toner image corresponding to the pseudo original is less than the threshold value for the pseudo original, while selecting the amount of light for high density as the amount of light to be irradiated for fog detection if the second density data outputted with respect to the toner image corresponding to the pseudo original is not less than the threshold value for the pseudo original.

13. The adjusting apparatus according to claim 10, wherein the reference density data has a value larger by a predetermined value than a third density data which is outputted by the density detecting device irradiating light of a minimum amount onto the photoreceptor on which no toner adheres.

14. The adjusting apparatus according to claim 9, wherein the density detecting device is capable of irradiating light of amounts in a plurality of steps from a minimum amount to a maximum amount, and the amount of light for low density and the amount of light for high density are predetermined amounts of light out of the amounts of light in the plurality of steps.

15. The adjusting apparatus according to claim 14, wherein the density detecting device outputs density data roughly inversely proportional to an amount of light reflected from the photoreceptor, and the amount of light for low density is determined by performing the steps of: irradiating light of amounts in a plurality of steps by the density detecting device onto the photoreceptor on which no toner adheres, finding out a maximum step of said plurality of steps in which data outputted by the density detecting device takes a value of not less than a predetermined value, and determining the amount of light in the maximum step as the amount of light for low density.

16. The adjusting apparatus according to claim 15, wherein the amount of light for high density is an amount of light found by substituting the amount of light for low density in a predetermined conversion equation.

* * * * *